US006026633A

United States Patent [19]

Burke, Jr.

[11] Patent Number: 6,026,633

[45] Date of Patent: Feb. 22, 2000

[54] EASY MOUNT STIRRUP

[76] Inventor: Earl P. Burke, Jr., 2121 Kirby, Houston, Tex. 77019

[21] Appl. No.: 09/104,101

[22] Filed: Jun. 24, 1998

Related U.S. Application Data

[60] Provisional application No. 60/050,775, Jun. 25, 1997.

[51] Int. Cl.[7] ..... B68C 3/00

[52] U.S. Cl. ..... 54/47

[58] Field of Search ..... 54/47, 49.5

[56] References Cited

U.S. PATENT DOCUMENTS

| | | | |
|---|---|---|---|
| 568,939 | 10/1896 | Davis . | |
| 592,587 | 10/1897 | Hollister . | |
| 592,588 | 10/1897 | Hollister . | |
| 706,468 | 8/1902 | Wellman . | |
| 717,850 | 1/1903 | Hey et al. | 54/47 |
| 726,534 | 4/1903 | Hollicott . | |
| 4,761,938 | 8/1988 | Townsend | 54/47 |
| 5,347,797 | 9/1994 | Seal et al. | 54/46.1 |
| 5,661,957 | 9/1997 | Daly | 54/47 |

FOREIGN PATENT DOCUMENTS

| | | | |
|---|---|---|---|
| 2 258 772 | of 0000 | France . | |
| 73 40595 | 8/1975 | France | 54/47 |
| 509 | 2/1875 | United Kingdom | 54/48 |

OTHER PUBLICATIONS

PCT International Search Report, PCT/US98/13148, filed Jun. 24, 1998, 17 pages.

Advertisement, Horse County 1999, author unknown.

*Primary Examiner*—Robert P. Swiatek

*Attorney, Agent, or Firm*—Conley, Rose & Tayon, P.C.

[57] ABSTRACT

A stirrup includes a crossbar, a first U-shaped member, a second U-shaped member slidably connected to the first U-shaped member, and a retraction mechanism. The crossbar connects two sides of the first U-shaped member. The second U-shaped member is adapted to slide between first and second positions on the first U-shaped member. The retraction mechanism is biased to retract the second U-shaped member from the first position to the second position. A method for facilitating mounting of a riding animal is provided. The method includes extending a first portion of a stirrup, climbing onto the riding animal by putting a foot on the extended first portion of the stirrup, and retracting the extended first portion of the stirrup in response to releasing foot pressure from the first portion. The act of extending includes sliding the first portion downward along a second portion of the stirrup.

27 Claims, 10 Drawing Sheets

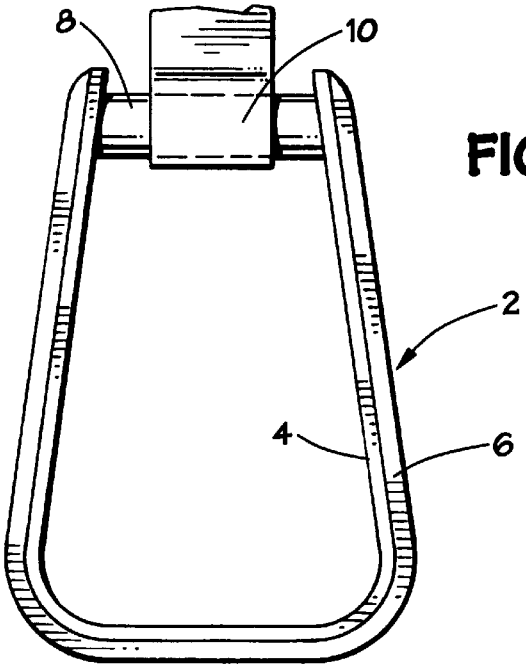
FIG. 1
FIG. 2
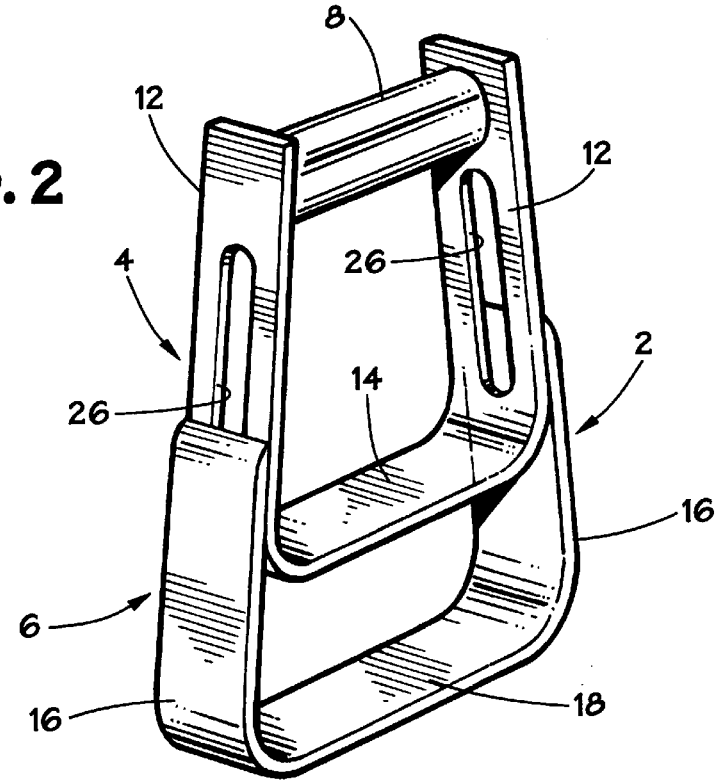

FIG. 4A
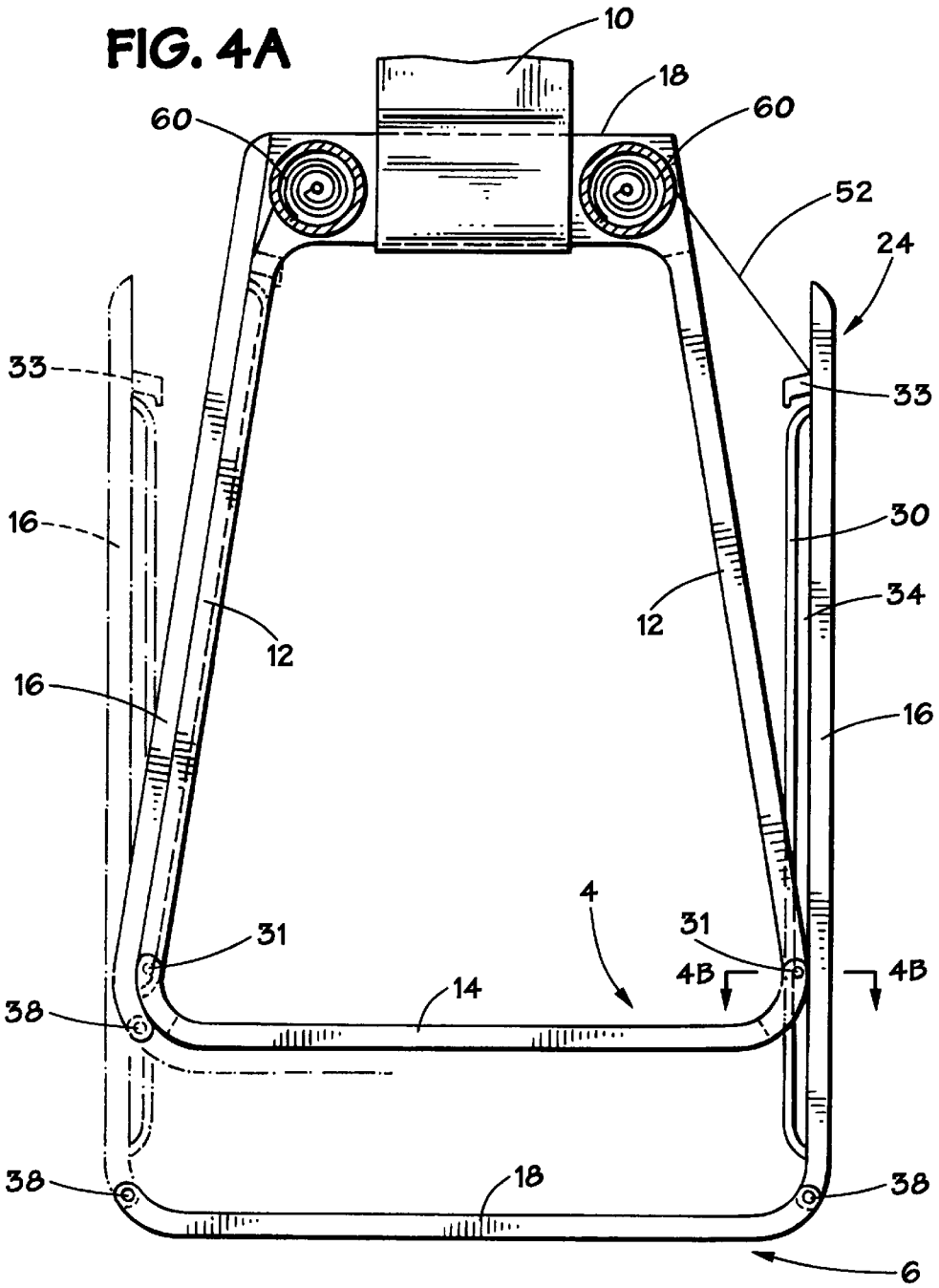
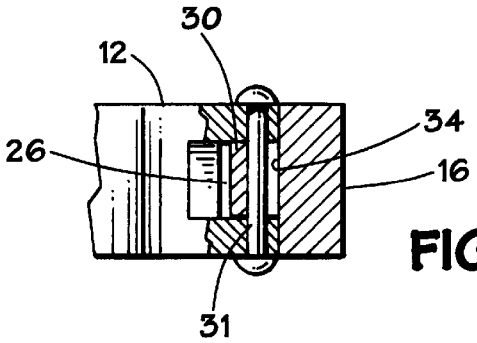
FIG. 4B

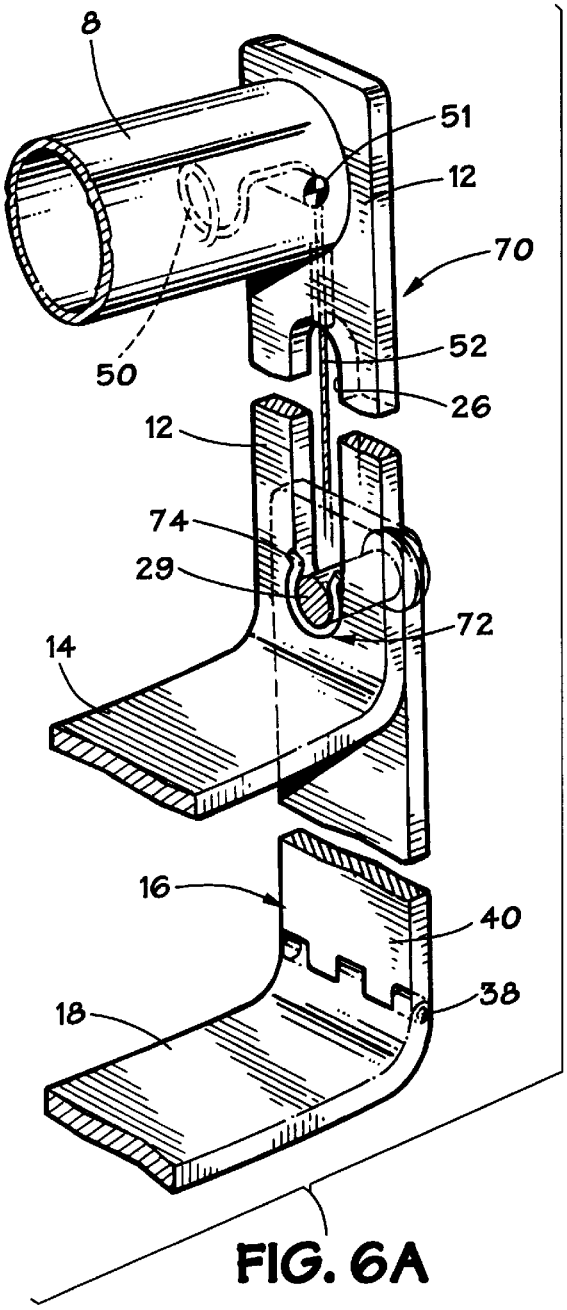
FIG. 6A
FIG. 7
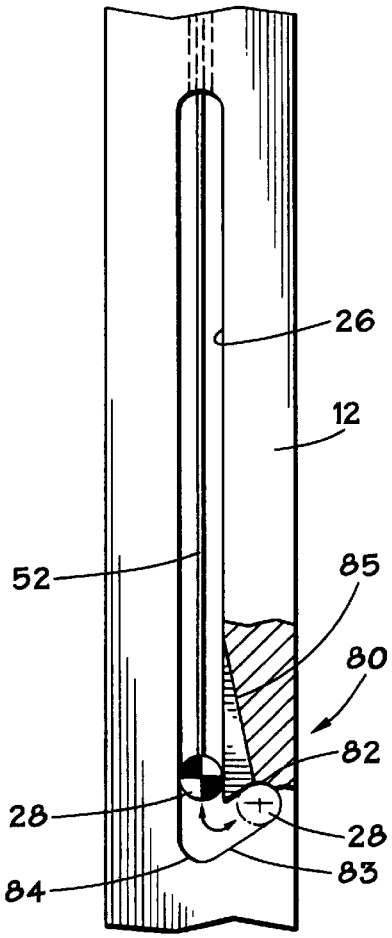

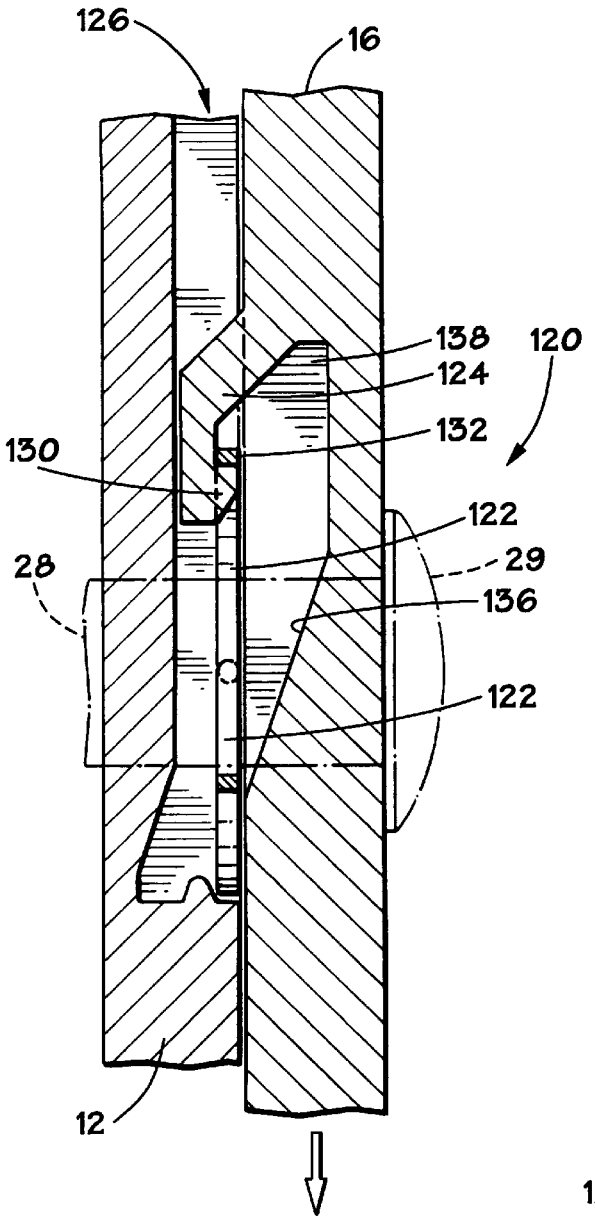
FIG. 8B
FIG. 8A
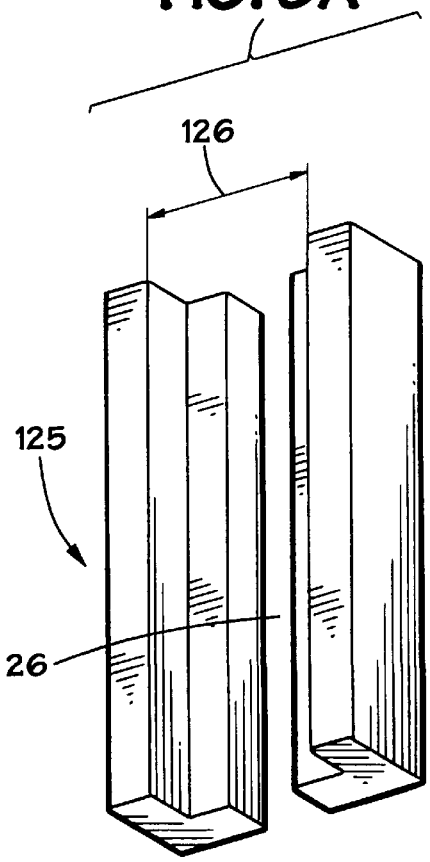

EASY MOUNT STIRRUP

This application claims the benefit of U.S. Provisional Application No. 60/050,775 filed on Jun. 25, 1997.

BACKGROUND OF THE INVENTION

1. Field of the Invention

The present invention relates generally to riding equipment, and more particularly to extendible stirrups for aiding a rider to mount a riding animal.

2. Description of the Related Art

The construction of riding saddles and accessories suited to shorter riders, younger riders, and riders with decreased mobility presents special challenges. These riders often need external aid, e.g., aid from another person or an elevated object, to mount a tall horse or other riding animal. External aid is often unavailable or inconvenient. If the need for external mounting aid can be eliminated, horseback riding will be more available to the above-mentioned group of riders.

The prior art includes several devices designed to aid a rider to mount a horse. A first such device is the separate mounting stirrup. The separate mounting stirrup attaches to the saddle and hangs closer to the ground than a riding stirrup. One deficiency of the separate mounting stirrup is that it remains attached to the saddle during riding. The separate mounting stirrup can frighten both the riding animal and the rider by flapping around during a brisk ride and can also snag on brush and downed trees. A second such device is the stirrup extension. Some stirrup extensions are also inconvenient, because they too remain extended during riding. Other stirrup extensions lack the rigidity to solidly support the rider as he or she climbs up on the horse. They either sag under the rider's weight or rotate too easily. Similar mechanical inadequacies are inherent in many prior art mounting aids.

More mounting aids have been developed for English riding gear. These aids are not always adaptable to western riding tackle even though western riders often prefer taller and more difficult to mount horses. Many known mounting aids would detract from the aesthetic appearance of the horse, rider, and riding gear if they were modified for use with western riding equipment.

The present invention is directed to overcoming, or at least reducing the effects of, one or more of the problems set forth above.

SUMMARY OF THE INVENTION

In a first aspect of the present invention, a stirrup is provided. The stirrup includes a crossbar; a first U-shaped member, a second U-shaped member slidably connected to the first U-shaped member and a retraction mechanism. The crossbar connects two sides of the first U-shaped member. The second U-shaped member is adapted to slide between first and second positions on the first U-shaped member. The retraction mechanism is biased to move the second U-shaped member from the first position to the second position.

In a second aspect of the present invention, a method for facilitating mounting of a riding animal is provided. The method includes extending a first portion of a stirrup. climbing onto the riding animal by putting a foot on the extended first portion of the stirrup, and retracting the extended first portion of the stirrup in response to releasing foot pressure from the first portion. The act of extending includes sliding the first portion downward along a second portion of the stirrup.

BRIEF DESCRIPTION OF THE DRAWINGS AND PHOTOS

Other objects and advantages of the invention will become apparent upon reading the following detailed description and upon reference to the Figures in which:

FIG. 1 is a view of one embodiment of an extendible stirrup in a retracted position;

FIG. 2 is a view of the embodiment of FIG. 1 in an extended position;

Figure 3A:
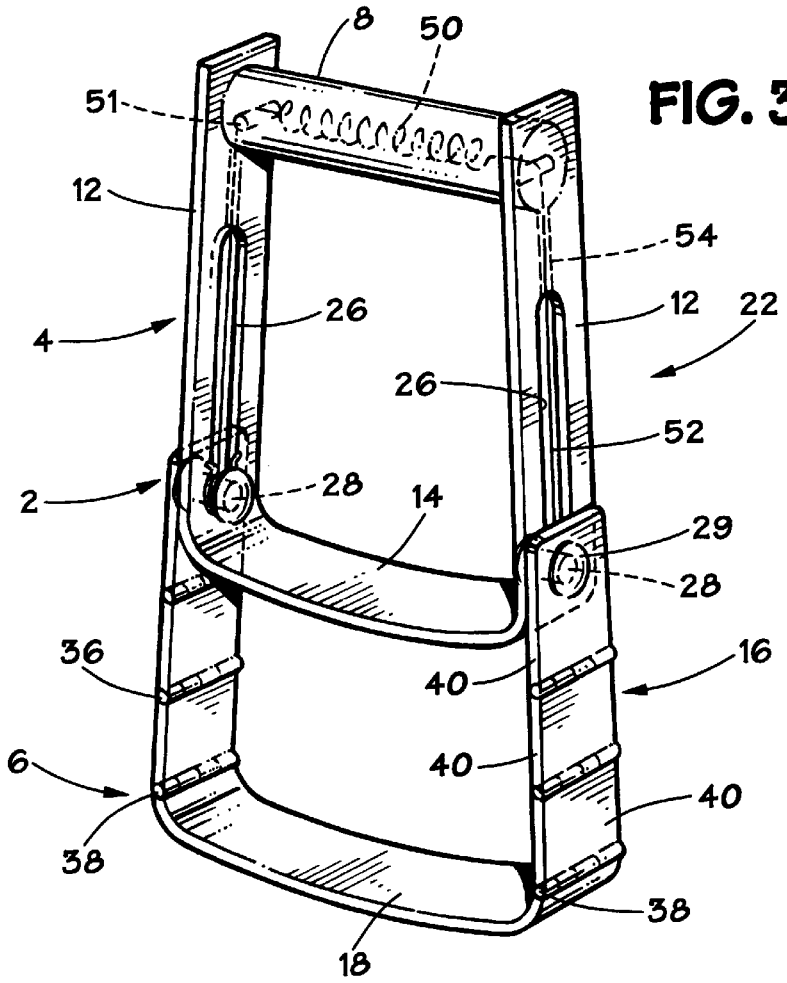
Figure 3B:
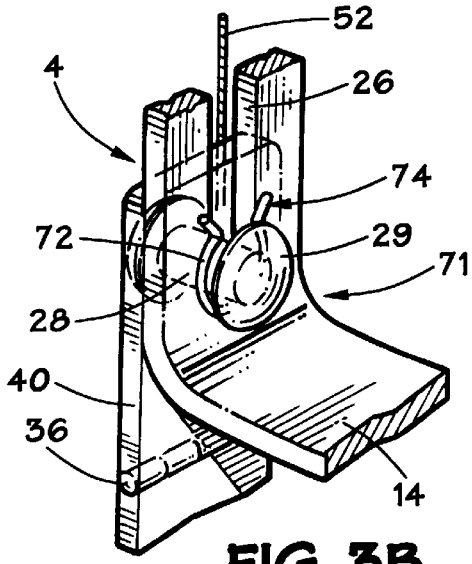
Figure 3C:
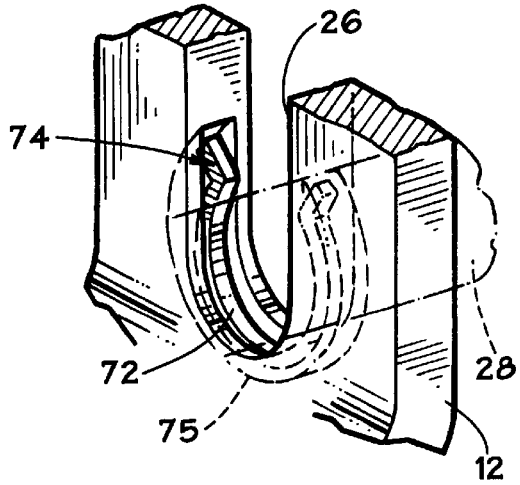
Figure 5A:
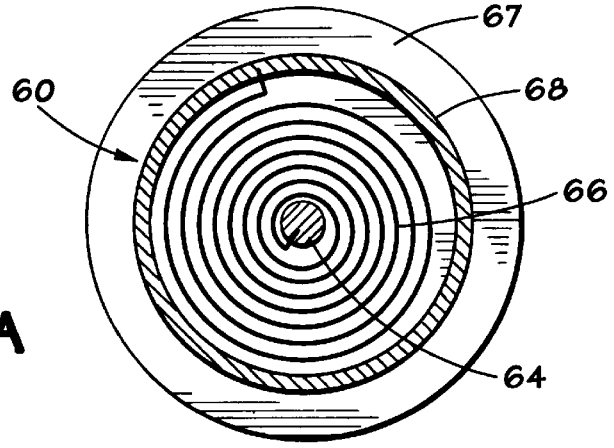
Figure 5B:
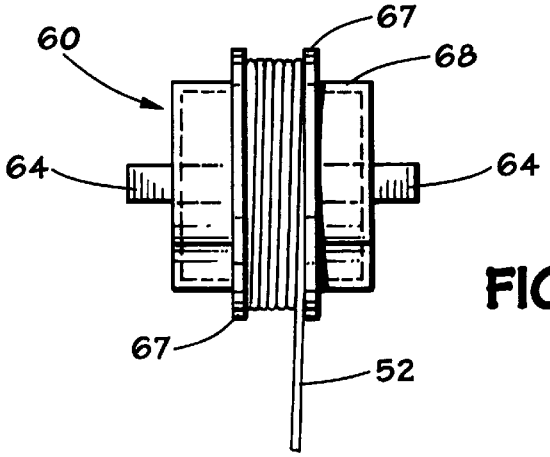
Figure 6B:
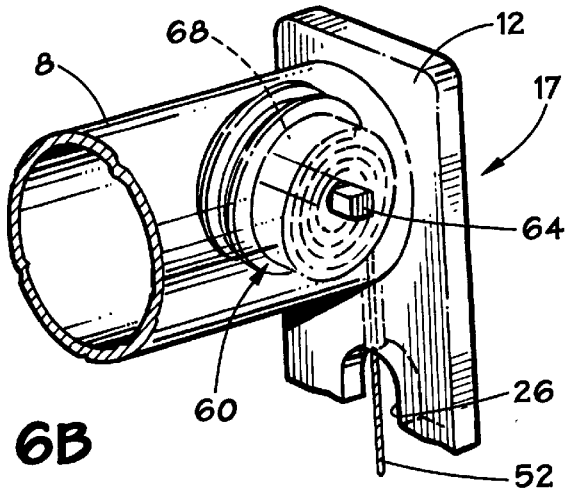
Figure 8D:
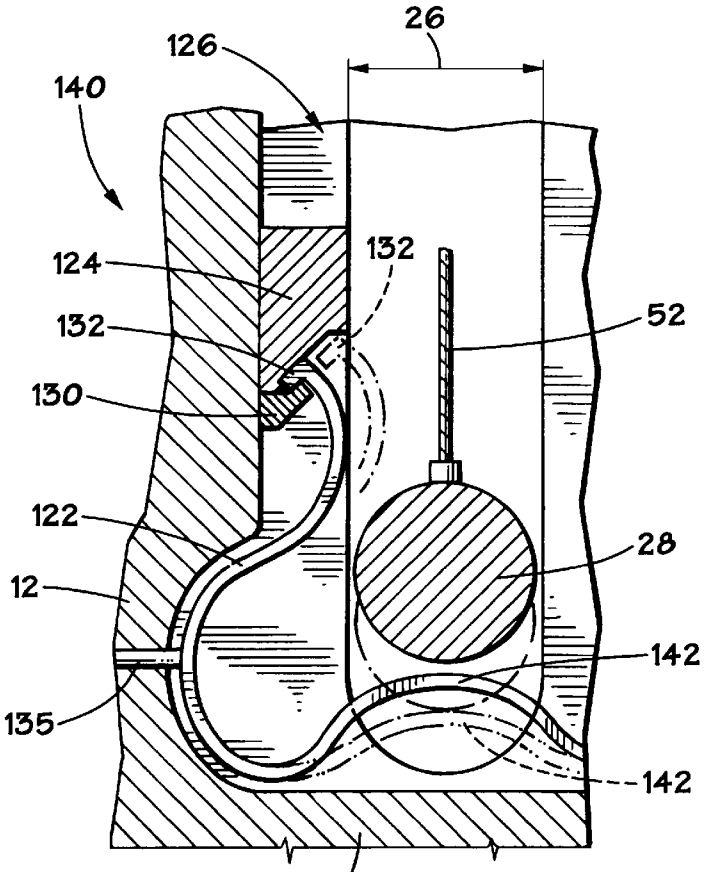
Figure 8C:
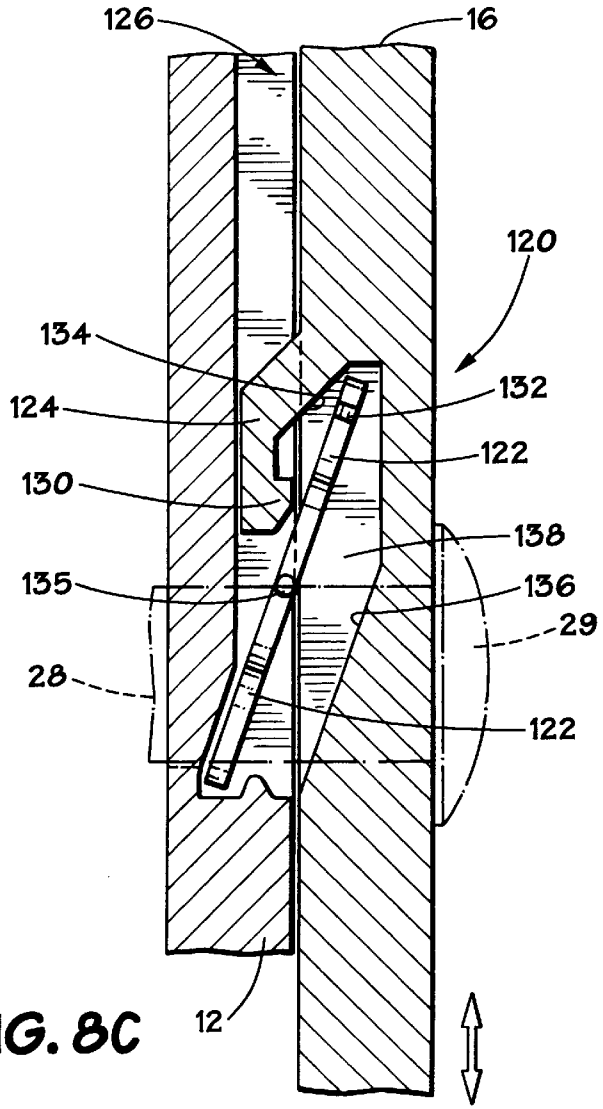
Figure 9:
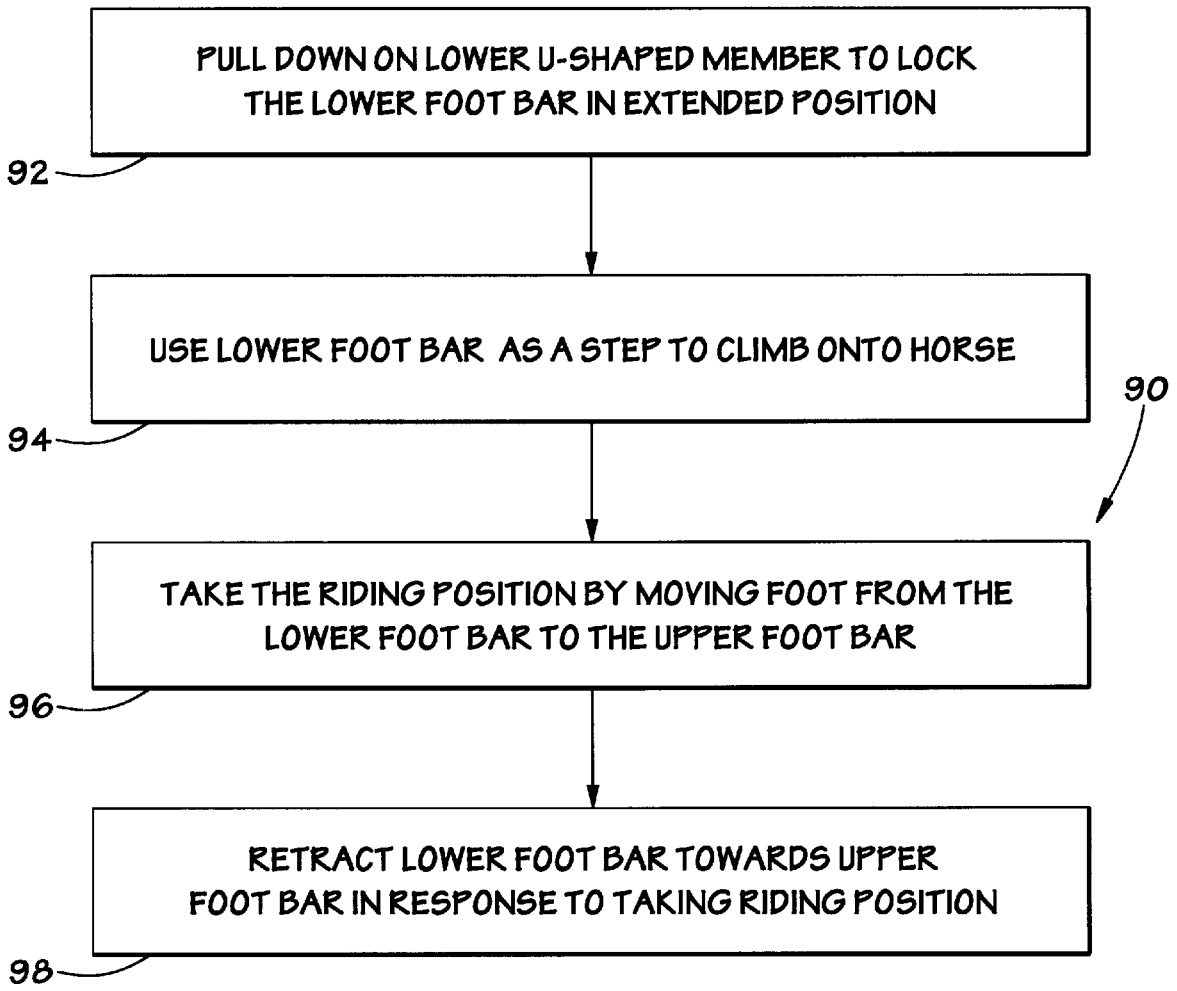
Figure 10B:
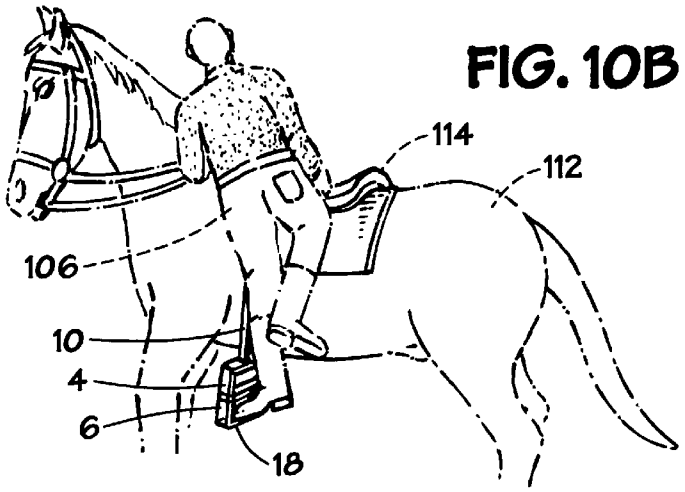
Figure 10C:
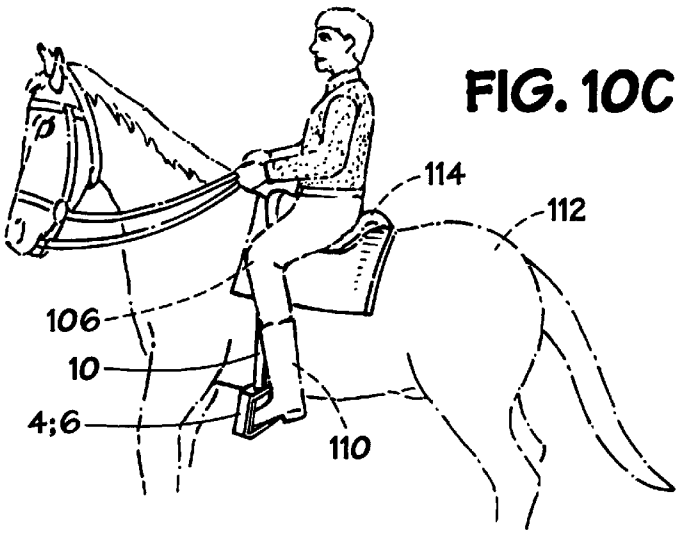
Figure 10A:
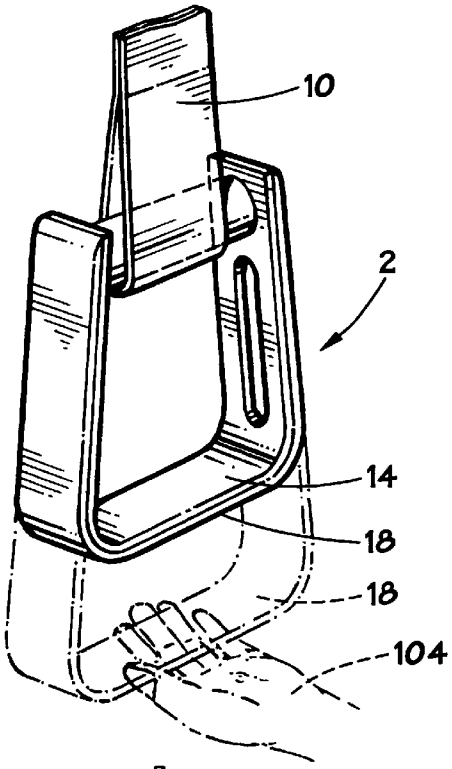

FIGS. 3A and 3B detail one particular embodiment for the extendible stirrup of FIGS. 1 and 2 in which bolts guide the sliding of the lower U-shaped member along the upper U-shaped member;

FIG. 3C illustrates one embodiment for attaching the wire keeper of FIG. 3B to the upper side member;

FIG. 4A illustrates a second embodiment for an extendible stirrup in which track bars guide the sliding of the lower U-shaped member along the upper U-shaped member;

FIG. 4B is a top view of the track bar and the thin bolt retaining the track bar in the longitudinal slot of the embodiment of FIG. 4A;

FIG. 5A details the coil spring employed in the retraction mechanism of one particular embodiment;

FIG. 5B is a side view of the exterior of the coil spring of FIG. 5A;

FIG. 6A illustrates a wire keeper capable of locking the extendible stirrup in the extended position, as may be employed in some alternative embodiments;

FIG. 6B illustrates a retraction mechanism for the extendible stirrup of FIGS. 3A and 4A, which employs a coil spring;

FIG. 7 illustrates a J-shaped extension of the longitudinal slot, which is capable of locking the extendible stirrup in the extended position;

FIG. 8A is a view of a portion of the outer face of one of the upper side members in an embodiment employing an alternate means for locking the stirrup in the extended position;

FIGS. 8B and 8C show how the extendible stirrup, partially illustrated in FIG. 8A, locks in the extended position and releases from the locked configuration;

FIG. 8D illustrates how the spring catch of the embodiment of FIGS. 8B–8C locks the stirrup in the extended position and releases from the locked position;

FIG. 9 is a flowchart illustrating one method of using the extendible stirrups of FIGS. 1–8D; and FIGS. 10A, 10B, and 10C illustrate the operation of the extendible stirrup of FIGS. 1 and 2.

Figure 11:
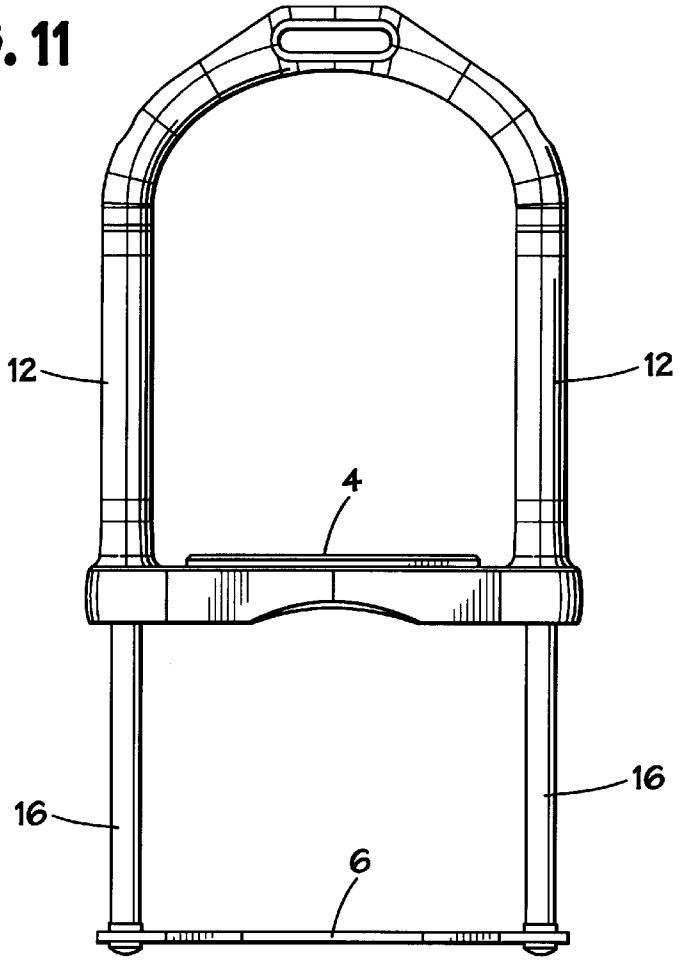

FIG. 11 shows a third embodiment for an extendible stirrup in which the sides of upper U-shaped member are hollow and the lower U-shaped member is extended.

Figure 12:
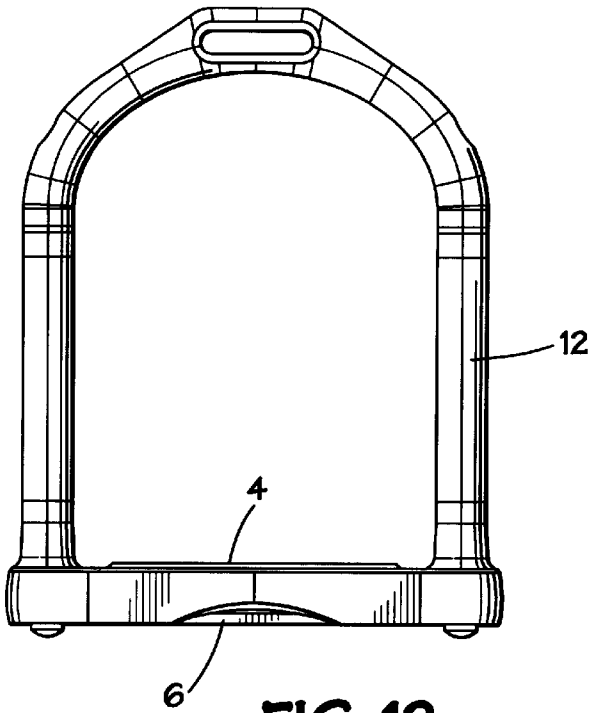

FIG. 12 illustrates the embodiment shown in FIG. 11 with the sides of lower U-shaped member retracted into the hollow sides of the upper U-shaped member.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that, even if such a development effort might be complex and time-consuming, it would nevertheless be a routine undertaking for those of ordinary skill in the art having the benefit of this disclosure.

The various, alternative, specific embodiments for extendible stirrups, in accordance with the present invention, have upper and lower U-shaped members, the position of the lower U-shaped member being adjustable. The upper U-shaped member is a full stirrup, which attaches in a known manner to a stirrup strap of the saddle. The upper U-shaped member supports a rider's foot during riding. The lower U-shaped member slidably attaches to the upper U-shaped member and has a foot bar, which can be extended downward to give the rider a lower "step" for climbing up on the riding animal. Thus, the rider need not raise his or her foot all the way up to the riding stirrup to climb onto the riding animal. The lower U-shaped member and the associated foot bar automatically retract toward the upper U-shaped member when the rider's foot is removed. When the rider is positioned on the riding animal, the two U-shaped members remain snugly together and detract less from the aesthetic appeal of the rider, the riding gear, and the riding animal.

FIG. 1 illustrates one particular embodiment of an extendible stirrup 2 in the retracted or riding position. The extendible stirrup 2 includes upper and lower U-shaped members 4, 6 and a crossbar 8. The U-shaped members 4, 6 and crossbar 8 may be fabricated of hard plastic, steel, aluminum or other rigid materials that do not substantially give under a rider's weight. A stirrup strap 10 wraps around the crossbar 8 to attach the extendible stirrup 2 to a saddle (not shown). In the illustrated embodiment, the upper and lower U-shaped members 4, 6 narrows substantially at the mouth formed by the U-shape, i.e., the form of western-style riding stirrups. In some embodiments, the U-shaped members 4, 6 do not substantially narrow or widen toward the mouth. The invention also covers other shapes for the U-shaped members 4, 6, e.g., the crossbar 8 and upper U-shaped member may have the shape of an English-style riding stirrup as shown in FIGS. 11 and 12. The lower U-shaped member 6 rests snugly against the upper U-shaped member 4 in the retracted position.

FIG. 2 is a view of the extendible stirrup 2 of FIG. 1 in the extended position. The upper U-shaped member 4 has two side members 12 and a foot bar 14. The lower U-shaped member 6 has two side members 16 and a foot bar 18. The lower U-shaped member 6 is adapted to slide smoothly along a portion of the length of the two side members 12 of the upper U-shaped member 4.

FIGS. 3A–B and 4A–B illustrate embodiments 22, 24 of the extendible stirrup in which protrusions 28, 30 of the side members 16 fit into longitudinal slots 26 of the side members 12 to guide the sliding of the lower U-shaped member 6. In the particular embodiments illustrated, the protrusions are bolts 28, in FIGS. 3A–3B, and track bars 30, in FIGS. 4A–4B, although the invention is not so limited. In FIGS. 3A–3B, bolt heads 29 keep the upper and lower U-shaped members 4, 6 attached. In FIGS. 4A–4B, a thin bolt 31 passes through a longitudinal slot 34 of the track bar 30 to keep the upper and lower U-shaped members 4, 6 attached. To increase the smoothness of the sliding motion of the lower U-shaped member 6, the outer diameter of the protrusions 28, 30 may closely match the width of the longitudinal slots 26.

Referring to FIGS. 3A–3B, the side members 16 may include transverse hinges 36, 38 so that the lower U-shaped member 6 can readjust to the varying width of the upper U-shaped member 4 during sliding. Each side member 16 consists of three flat plates 40 joined by the transverse hinges 36. One hinge 38 connects the lowest of the plates 40 to the foot bar 18. The hinges 36, 38 enable the side members 16 to flex while sliding around the upper foot plate 14 of the upper U-shaped member 4.

Referring to FIG. 3A, an alternate embodiment may use flexible straps (not shown) to form the side members 16. The flexible straps may be constructed with a variety of materials such as nylon, leather, cloth, or flexible plastic.

Referring again to FIGS. 11 and 12, other embodiments may employ hollow side members 12 for the upper U-shaped member 4. In this embodiment, the cross-sections of the side members 16 of the lower U-shaped member 6 fit snugly inside the hollow interiors of the side members 12 of the upper U-shaped member 4. In this embodiment, the hollow interiors of the side members 12 of the upper U-shaped member 4 guide the sliding motion of the side members 16 of the lower U-shaped member 6. The cross-sections of the side members 12, 16 of the upper and lower U-shaped members 4, 6 may take a variety of matching shapes, e.g., circular, oval, square, triangular, and rectangular. The above-described side members may be used, for example, in embodiments of the extendible stirrup 2 having the form of an English saddle stirrup such as shown in FIGS. 11 and 12.

The above-described hollow and matching cross-section side members 12, 16, the slots 26 and bolts 28 of FIGS. 3A–3B, and the slots 26 and track bars 30 of FIGS. 4A–4B form alternate means for slidably connecting the first and second U-shaped members 4,6.

Referring again to the particular embodiment of FIGS. 3A–3B, the crossbar 8 is, at least, partially hollow to house a retraction mechanism 50. The mechanism 50 may use an elastic material, a torsion spring, or a pair of coil springs. One embodiment uses "constant force springs" or "power springs" manufactured by Vulcan Spring and Manufacturing Company, 501 School House Road, Telford, Pa. 18969. A cord or wire 52, e.g., coated steel cable or a nylon filament, connects the retraction mechanism 50 to the side members 16 or to the bolts 28. Embodiments of the retraction mechanism 50 using an elastic material or a torsion spring pass the cord or wire 52 over a roller 51 and then through a longitudinal hole 54 in the side member 12 of the upper U-shaped member 4. Embodiments of the retraction mechanism 50 of FIGS. 4A and 6B use a coil spring positioned so that the cord or wire 52 feeds directly into the hole 54 without need for the roller 51 of FIG. 3A. The retraction mechanism 50 keeps the lower U-shaped member 6 under a tension biasing its return to the position snugly against the upper U-shaped member 4.

Referring again to FIG. 4A, the retraction mechanism 50 uses two coil springs 60 to keep the wires 52 under tension. Each wire 52 connects one of the side members 16 to one of the coil springs 60. On release of foot pressure on the lower foot bar 18, coil springs 60 rewind the wires 52 retracting the lower U-shaped member 6 to a position snugly against the upper U-shaped member 4.

The retraction mechanism 50, e.g., the elastic material/tension spring of FIG. 3A or the coil spring 60 of FIGS. 4A–B, and the cord or wire 52 connecting the retraction mechanism 50 to the lower U-shaped member 6 of FIGS. 1–2, 3A and 4B form means for retraction.

FIGS. 5A and 5B show one of the coil springs 60 of FIG. 4A in more detail. The coil spring 60 includes a central arbor 64, a coiled strip of spring metal 66, and a circular drum 68. One end of the coiled strip of spring metal 66 attaches to the central arbor 64 and the other end attaches to the circular drum 68. The central arbor 64 is rigidly fixed to the interior of the crossbars 8 of the extendible stirrups 22, 24 of FIGS. 3A and 4A. The circular drum 68 is free to rotate under the tension produced by the coiled strip of spring metal 66 thereby rewinding the wire 52 of FIGS. 3A–4A. The coil spring 60 keeps the wire 52 under a substantially constant tension of approximately 6.7 to 11.1 newtons (48 to 80 foot pounds per second squared) at intermediate positions between the retracted and fully extended positions.

Referring to FIGS. 3A through 5A, the crossbar 8 has a round or a U-shaped cross-section. One embodiment has a round crossbar 8 with an internal diameter of about 2.54 centimeters (cm) (1.0 inch). In one embodiment, the wire 52 is a steel cable of less than about 0.16 cm (1/16 inches) diameter, and the drum 68 is made of metal or plastic and has a diameter of about a 1.3 cm (0.5 inches) and a width of about 1.9 cm (0.75 inches). The drum 68 has two side guard flanges 67, which are about 1.9 cm high (0.75 inches). The coiled strip of spring metal 66 is stainless steel and has a width of about 0.63 cm (0.25 inches) and a thickness sufficient to provide an adequate retraction force. In the above embodiment, the central arbor 64 may be steel or plastic and has a width of about 0.32 cm (0.125 inches). The ends of the central arbor 64 may be square (not shown) so that the is arbor 64 seats non-rotatably into slots (not shown) in the sides of the crossbar 8, or the arbor 64 may be affixed non-rotatably to the crossbar 8 in other manners. The above-described embodiment for the retraction mechanism enables extending the lower U-shaped member 6 by about 7.6 to 15.2 cm (3 to 6 inches) under a substantially constant return force of about 6.7 to 11.1 newtons (48 to 80 foot pounds per second squared).

FIGS. 3B and 6A illustrate first devices 71, 70 for locking the lower U-shaped member 6 of the extendible stirrup 2 of FIGS. 1 and 2 in the extended position, i.e., a spring-like wire keeper 72. The wire keeper 72 is firmly attached to the upper side member 12, e.g., FIG. 3C show one method for attaching the keeper 74 to the bottom of the longitudinal slot 26, .i.e., inserting the wire keeper 72 into a recess 75. When the rider (not shown) pulls down to extend the lower U-shaped member 6, the bolt head 29 of the stirrup 22 of FIGS. 3A–3B or the metal catch 33 of the stirrup 24 of FIG. 4A passes through the wire keeper's jaws 74. The jaws 74 reclose to grasp the bolt head 29 or metal catch 33 thereby locking the stirrups 22, 24 of FIGS. 3A–3B and 4A in the extended position while the rider lifts his foot up to the lower foot bar 18. During mounting, additional downward pressure on the lower foot bar 18, due to the rider's weight, pushes the bolt 28 further downward to reopen the wire keeper 72. The bolt head 29 or metal catch 33 slides back through the keeper's jaws 74, releasing the lower U-shaped member 6 when the rider suddenly releases pressure on the lower foot bar 18 by removing his or her foot therefrom to take the riding position (not shown). The devices 70, 761 enable the rider to lock the stirrups 22, 24 of FIGS. 3A–3B or 4A–4B in the fully extended position while he or she raises his or her foot onto the lower foot bar 18. The wire keeper 72 may take a variety of forms known to those of ordinary skill in the art to provide the above-described operation.

FIGS. 5B and 6B detail an embodiment 17 of the retraction mechanism 50 of the extendible stirrup 22 of FIGS. 3A–3B, which employs the coil spring 60 of FIGS. 5A. The arbor 64 fits non-rotatably into the sides of the partially hollow crossbar 8 as shown in FIG. 6B. One end of the wire 52 attaches to and wraps around the drum 68 between the two guard flanges 67. The other end of the wire 52 couples to the lower U-shaped member 6 of FIGS. 1 and 2 or to the bolt 28 of FIG. 3A. Each side member 16 of the lower U-shaped member 6 couples to one of the wires 52, and each of the wires 52 connects to a separate one of the coil springs 60.

FIG. 7 illustrates a second device 80 for locking the lower U-shaped member 6 of FIGS. 1, 2, 3A, and 4A in the extended position. The device 80 has an extension 82 at the bottom of each of the longitudinal slots 26 of the upper U-shaped member 4. The width of the longitudinal and J-shaped extension slots 26, 83, and the diameter of either the bolt 28, in the stirrup 22 of FIG. 3A, or of the metal catch 33, in the stirrup 24 of FIG. 4A, are substantially equal and given by about 0.95 cm (0.375 inches) in one embodiment. Hand pressure suffices to extend the lower U-shaped member 6 and position either the bolt 28 or the metal catch 33 in the extension 82. Additional pressure from the rider's weight on the lower foot bar 18 causes the bolt 28 to slide down to the notch 84. Then, under the tension of the retraction mechanism 50, the bolt 28 or metal catch 33 naturally slides back up the longitudinal slot 26 in response to being released from the notch 84.

Still referring to FIG. 7, the region between the longitudinal and J-shaped extension slots 26, 83 may have a groove 85 to receive the cord or wire 52 so that tension therefrom does not pull the bolt 28 out of the J-shaped extension 82. The groove 85 may pass through the center of the width of the upper side member 12 or be asymmetrically disposed with respect to the width of the upper side member 12. In one embodiment, the groove 85 extends along about a third of the length of the longitudinal slot 26.

FIGS. 8A–8D illustrate a third device 120 for locking the lower U-shaped member 6 of FIGS. 1, 2, and 3A in the extended position. The device 120 includes a flexible spring catch 122 rotatable attached to each upper side member 12, an arm 124 rigidly fixed to each lower side member 16, and a pair of bolts 28. The bolts pass through holes in the lower side members 16 and the longitudinal slots 26 of the upper side members 12. The 3-dimensional view of FIG. 8A of a portion 125 of the upper side member 12 shows a longitudinal groove 126 positioned along the outside face of the longitudinal slot 26. Each bolt 28 slidably joins the upper and lower side members 12, 16 by passing through the slot 26. The arms 124 extend into the grooves 126 in a manner that enables a sliding connection between the upper and lower side members 12, 16.

FIGS. 8B illustrates how the device 120 locks in the extended position. As the rider pulls the lower U-shaped member 6 downward, a triangular extension 130 of the arm 124 pushes the ends 132 of the spring catch 122 (see FIG.

8D) inward. When the triangular extension 130 slides past the ends 132, the spring catch 122 re-expands pushing the ends 132 over the triangular extensions 130. When the ends 132 of the spring catch 122 are caught on top of the triangular extensions 130, the lower U-shaped member 6 of FIGS. 1, 2, and 3A is locked in the extended position.

FIG. 8C illustrates how the device 120 releases from the locked configuration of FIG. 8B. The weight of the rider's foot on the lower foot bar 18 of FIG. 2 pushes the lower side member 16 further downward. During the downward motion a diagonal surface 134 of the arm 124 tilts the spring catch 122 around a pivot axis 135 away from the longitudinal direction. In the tilted position the ends 132 of the spring catch 122 are not caught on the triangular extensions 130 of the arms 124. When the rider removes his weight from the lower foot bar 18 of FIG. 2, the retraction mechanism 50 of FIG. 3A can retract the lower U-shaped member 6 without catching the ends 132 of the spring catch 122 on the triangular extensions 130. As the side member 16 moves upward, a diagonal wall 136 of the cavity 138 tilts the spring catch 122 back to the vertical direction thereby reading the spring catch 122 to lock the next time that the rider extends the lower U-shaped member 6.

FIG. 8D is a blow up view 140 of the outer face of the side member 12 of FIG. 2 and of the portion of the arm 124 that enters into the longitudinal groove 126 along the outer face of the side member 12. The blow up view 140 shows how one of the ends 132 of the spring catch 122 catches over the triangular extension 130 of the arm 124. As the side member 16 of the lower U-shaped member 6 moves down further, the bolt 28 compresses a bump 142 of the spring catch 122 thereby causing the ends 132 to be pushed inward, i.e., off the triangular extensions 132. The inward motion of the ends 132 facilitates the tilting the spring catch 122 with the diagonal surface 134 as the downward movement of the side member 16 continues.

Referring to FIGS. 3A–3B, 4A–4B and 5A–5B, a fourth device for locking the lower U-shaped member 6 of FIG. 1–2 in the extended position is a cam locking mechanism (not shown) for the coil springs 60 of FIGS. 4A and 5A. The cam locking mechanism reversibly locks the coil spring 60 at a fixed internal tension when external forces on the wire 52 release at a fixed extension. Subsequently, pulling on the wire 52 releases the cam lock (not shown) allowing the lower U-shaped member 6 to extend or retract. Such cam locking mechanisms are well known in the art and may, for example, include a ratcheting device (not shown).

The invention is intended to also cover other devices for locking the stirrup 2 of FIGS. 1–2 in the extended position. These devices may include one or more hooks, catches or clips (all not shown) known to those of ordinary skill in the art. These devices can be positioned at the base of the slots 26 of FIGS. 3A and 4A to grasp/release the bolt head 29 or the catch 33 thereby locking/releasing the lower U-shaped member 6 by techniques known to those of ordinary skill in the art.

The bolt 28 or metal catch 33 of FIGS. 3A–4A with the wire keeper 72 of FIG. 6A, the bolt 28 or metal catch 33 of FIGS. 3A–4A with the J-shaped extension slot 82 of FIG. 7, and the device 120 of FIGS. 8A–8D form alternate means for locking the lower U-shaped member 6 in the extended position. The cam locking mechanisms for the coil springs 60 form another means for locking the lower U-shaped member 6 in the extended position.

FIG. 9 is a flowchart of steps of a method 90, performed by a rider (not shown), to use the extendible stirrup 2 of FIGS. 1–7. At block 92, the rider manually pulls down on the lower U-shaped member 6 to lock the lower foot bar 18 in the extended position, i.e., a position in which the lower and upper foot bars 14, 18 are not adjacent. The rider locks the lower foot bar 18 by using either the wire keeper 72 of FIG. 6A, the J-shaped extension 82 of FIG. 7, or the cam locking mechanisms of the coil springs 60 of FIGS. 4A and 5A to lock the lower U-shaped member 6 in the extended position. At block 94, the rider climbs into the saddle (not shown) on the horse or other riding animal (not shown) using the lower foot bar 18 as a step. At block 96, the rider takes the riding position by moving his or her foot from the lower foot bar 18 to the upper foot bar 14, i.e., the riding foot bar. At block 98, the retraction mechanism 50 retracts the lower foot bar 18 to a position substantially adjacent the upper foot bar 14 in response to the rider taking his or her foot off the lower foot bar 18.

The extendible stirrups of FIGS. 1–8 are not limited to use for mounting horses. Rather, the invention may be used on other riding animals such as donkeys, mules, llamas, alpacas, bulls, and elephants (all not shown). The invention may also be used to mount mechanical riding machines such as an electric bull machine (not shown).

FIGS. 10A, 10B, and 10C illustrate the operation stirrup 2 of FIGS. 1 and 2 for mounting a horse. FIG. 10A illustrates a rider 106 using his or her hand 104 to lock the extendible stirrup 2 in the extended position. FIG. 10B shows the rider 106 placing his or her boot 110 on the foot bar 18 of the lower U-shaped member 6 to aid in mounting the horse 112. The stirrup strap 10 transmits the weight of the rider 106 from the extendible stirrup 2 to the riding saddle 114. The stirrup strap 10 attaches the extendible stirrup 2 to the riding saddle 114 on the mounting side, and a second stirrup strap attaches an ordinary stirrup (both not shown) to the riding saddle 114 on the other side. FIG. 10C shows the rider 106 after placing his or her boot 110 on the foot bar 14 of the upper U-shaped member 4, i.e., to take the riding position. The lower U-shaped member 6 automatically retracts snugly against the upper U-shaped member 4 in response to the rider 106 removing foot pressure from the lower U-shaped member 6 and remains retracted during riding.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A stirrup, comprising:

a crossbar;

a first U-shaped member, the crossbar connecting two sides of the first U-shaped member;

a second U-shaped member slidably connected to the first U-shaped member and adapted to slide between a first position and a second position on the first U-shaped member;

a retraction mechanism biased to move the second U-shaped member from the first position to the second position;

first and second protrusions on the second U-shaped member, the fist and second protrusions adapted to slide in first and second slots in the first U-shaped member; and at least one wire keeper, each wire keeper being adapted to hold at least one of the protrusions in response to the U-shaped member being in the first position.

2. A stirrup, comprising:

a) a crossbar;

b) a first U-shaped member, the crossbar connecting two sides of the first U-shaped member;

c) a second U-shaped member slidably connected to the first U-shaped member and adapted to slide between a first position and a second position on the first U-shaped member;

d) a retraction mechanism biased to move the second U-shaped member from the first position to the second position;

e) first and second protrusions on the second U-shaped member, the first and second protrusions adapted to slide in first and second slots in the first U-shaped member;

f) wherein at least one of the first and second slots has a J-shaped extension, the J-shaped extension being adapted to hold one of the protrusions in response to the second U-shaped member being in the first position.

3. The stirrup as set forth in claim 1 or 2, wherein the first and second protrusions include one of a bolt and a track bar.

4. A stirrup, comprising:

a) a crossbar;

b) a first U-shaped member, the crossbar connecting two sides of the first U-shaped member;

c) a second U-shaped member slidably connected to the first U-shaped member and adapted to slide between a first position and a second position on the first U-shaped member;

d) a retraction mechanism biased to move the second U-shaped member from the first position to the second position;

e) wherein:

i) the first U-shaped member includes first and second side members and a first foot bar, the first foot bar connecting first ends of the first and second side members, the crossbar connecting the first and second side members near second ends thereof; and ii) the second U-shaped member includes third and fourth side members and a second foot bar, the second foot bar connecting first ends of the third and fourth side members;

iii) the retraction mechanism comprises first and second protrusions coupled to the respective third and fourth side members, the first protrusion adapted to slide in a first slot in the first side member and the second protrusion adapted to slide in a second slot in the second side member; and iv) the first slot has a J-shaped extension, the J-shaped extension being adapted to hold the first protrusion in response to the second U-shaped member being in the first position.

5. The stirrup as set forth in claim 4, wherein each of the third and fourth side members comprise at least two hinged plates.

6. The stirrup as set forth in claim 4, wherein the second foot bar connects to the third and fourth side members by first and second hinges, respectively.

7. A stirrup comprising:

a) a crossbar;

b) a first U-shaped member, the crossbar connecting two sides of the first U-shaped member;

c) a second U-shaped member slidably connected to the first U-shaped member and adapted to slide between a first position and a second position on the first U-shaped member;

d) a retraction mechanism biased to move the second U-shaped member from the first position to the second position;

e) wherein:

i) the first U-shaped member includes first and second side members and a first foot bar, the first foot bar connecting first ends of the first and second side members, the crossbar connecting the first and second side members near second ends thereof; and ii) the second U-shaped member includes third and fourth side members and a second foot bar, the second foot bar connecting first ends of the third and fourth side members;

iii) the retraction mechanism comprises first and second protrusions coupled to the respective third and fourth side members, the first protrusion adapted to slide in a first slot in the first side member and the second protrusion adapted to slide in a second slot in the second side member; and iv) at least one wire keeper adapted to hold the first protrusion in response to the U-shaped member being in the first position.

8. The stirrup as set forth in claim 4 or 7, wherein the retraction mechanism comprises one of a cable, a wire, and a cord; the one of a cable, a wire, and a cord being capable of transmitting a force to the third side member.

9. The stirrup as set forth in any of claims 1, 2, 4, or 7, wherein the first and second U-shaped members have substantially narrower widths at the mouth of the U-shaped.

10. The stirrup as set forth in any of claims 1, 2, 4, or 7, wherein the first and second U-shaped members are substantially adjacent in the second position.

11. The stirrup as set forth in any of claims 1, 2, 4, or 7, wherein the retraction mechanism comprises at least one of a cable, a wire, and a line; the at least one of a cable, a wire, and a line being adapted to transmit a return force from the retraction mechanism to the second U-shaped member.

12. The stirrup as set forth in claim 11, wherein the retraction mechanism further includes at least one coil spring capable of producing the return force.

13. The stirrup as set forth in claim 12, wherein the at least one coil spring is adapted to reversibly lock, the second U-shaped member being fixed at the first position in response to the at least one coil spring locking.

14. The stirrup as set forth in any of claims 1, 2, 4, or 7, further comprising a coupling between the first and second U-shaped members, the coupling substantially limiting motion between the first and second U-shaped members to sliding motion.

15. The stirrup as set forth in any of claims 1, 2, 4, or 7, wherein said crossbar is partially hollow and holds a portion of said retraction mechanism.

16. A method for facilitating mounting of a riding animal, comprising:

a) extending a first portion of a stirrup, the act of extending including sliding the first portion along a second portion of the stirrup;

b) climbing onto the riding animal by placing a foot on the extended first portion of the stirrup;

(c) retracting the extended first portion of the stirrup in response to releasing foot pressure from the first portion;

wherein the act of extending includes manually placing a protrusion coupled to a first U-shaped member of the stirrup into a locking device of a second U-shaped member of the stirrup, the device selected from the group consisting of a J-shaped extension slot and a wire keeper.

17. The method as set forth in claim 16, wherein the act of retracting places riding and mounting foot bars of the stirrup substantially adjacent.

18. The method as set forth in claim 16, wherein the act of extending includes fixing a mounting foot bar to not be substantially adjacent a riding foot bar.

19. The method as set forth in claim 16, wherein the act of extending includes increasing tension of a spring, the act of retracting being performed by the spring.

20. A method of mounting a riding animal, comprising:

a) locking a lower foot bar of an extendible stirrup in an extended position, wherein the act of locking includes manually placing a protrusion coupled to a first U-shaped member of the extendible stirrup into a locking device on a second U-shaped member of the extendible stirrup, the device selected from the group consisting of a J-shaped extension slot and a wire keeper, the lower and riding foot bars being located on the first and second U-shaped members, respectively;

b) climbing onto the riding animal by using the lower foot bar of the extendible stirrup as a step; and c) retracting the lower foot bar towards a riding foot bar of the extendible stirrup in response to releasing foot pressure from the lower foot bar.

21. The method as set forth in claim 20, wherein the act of retracting places the lower foot bar substantially adjacent the riding foot bar.

22. The method as set forth in claim 20, wherein the act of locking includes fixing the lower foot bar to not be substantially adjacent the riding foot bar.

23. A stirrup, comprising:

a) a cross bar;

b) a first U-shaped member, the crossbar connecting two sides of the first U-shaped member;

c) a second U-shaped member slidably connected to the first U-shaped member and adapted to slide between a first position and a second position on the first U-shaped member;

d) a retraction mechanism biased to move the second U-shaped member from the first position to the second position; and e) a lock substantially interior to the stirrup adapted to releasably secure the second U-shaped member in the first position.

24. The stirrup as set forth in claim 23, wherein:

a) the first U-shaped member includes first and second side members and a first foot bar, the first foot bar connecting first ends of the first and second side members, the crossbar connecting the first and second side members near second ends thereof; and b) the second U-shaped member includes third and fourth side members and a second foot bar, the second foot bar connecting first ends of the third and fourth side members.

25. The stirrup as set forth in claim 24, wherein the first and second side members are partially hollow and the third and fourth side members are adapted to slide inside the first and second side members, respectively.

26. The stirrup as set forth in claim 24, wherein the lock releases in response to pressure applied to the second foot bar.

27. The stirrup as set forth in claim 24, wherein the first and second side members are substantially parallel.

* * * * *